US009245430B1

(12) United States Patent
Berg

(10) Patent No.: US 9,245,430 B1
(45) Date of Patent: Jan. 26, 2016

(54) BEVERAGE INSULATING COVER WITH REMOTE LOCATING MEANS

(76) Inventor: Jason S. Berg, St. Anthony, IN (US)

( * ) Notice: Subject to any disclaimer, the term of this patent is extended or adjusted under 35 U.S.C. 154(b) by 491 days.

(21) Appl. No.: 13/432,021

(22) Filed: Mar. 28, 2012

(51) Int. Cl.

| | |
|---|---|
| ***G08B 7/00*** | (2006.01) |
| ***G08B 7/06*** | (2006.01) |
| ***G08B 21/24*** | (2006.01) |
| *B65D 81/38* | (2006.01) |

(52) U.S. Cl.
CPC ..... *G08B 7/068* (2013.01); *G08B 21/24* (2013.01); *B65D 81/3879* (2013.01)

(58) Field of Classification Search
CPC ..... G08B 7/068; G08B 21/24; B65D 81/3879
USPC ..... 340/8.1, 539.1, 539.13; 206/446
See application file for complete search history.

(56) References Cited

U.S. PATENT DOCUMENTS

| | | | | |
|---|---|---|---|---|
| 4,476,469 | A * | 10/1984 | Lander | 340/8.1 |
| 4,858,084 | A | 8/1989 | Sheryll | |
| 4,886,183 | A | 12/1989 | Fleming | |
| 5,969,592 | A * | 10/1999 | Reed | 340/384.1 |
| 5,990,790 | A | 11/1999 | Lusareta | |
| 6,786,614 | B2 | 9/2004 | Ciarrocchi, Jr. | |
| 6,793,363 | B2 | 9/2004 | Jensen | |
| 2002/0180601 | A1 | 12/2002 | Street | |
| 2003/0210141 | A1 | 11/2003 | Iacovino | |
| 2004/0085204 | A1 | 5/2004 | Ogle | |
| 2006/0219858 | A1 | 10/2006 | Iacovino | |
| 2008/0083767 | A1 * | 4/2008 | O'Neal | 220/739 |
| 2011/0041544 | A1 * | 2/2011 | Ferguson et al. | 62/457.1 |

* cited by examiner

*Primary Examiner* — Edwin Holloway, III
(74) *Attorney, Agent, or Firm* — Montgomery Patent & Design; Robert C Montgomery

(57) ABSTRACT

A beverage koozie having a wireless locator that emits sounds under the control of a key fob. The koozie has an interior switch that causes a sound generator to emit sound when a beverage is placed in the koozie. The sound generator can also be activated by a key fob. In response to RF from the key fob the sound generator emits an audible signal to enable a user to find the koozie. The sound generator can also emit entertaining sounds when directed by the key fob.

8 Claims, 4 Drawing Sheets

BEVERAGE INSULATING COVER WITH REMOTE LOCATING MEANS

RELATED APPLICATIONS

Not Applicable.

FIELD OF THE INVENTION

The presently disclosed subject matter is directed towards beverage koozies (insulating devices that help keep a beverage cold and a user's hands warm). More particularly, the present invention is directed to beverage koozies having key fobs (electronic keys) that operate locators and sound generators.

BACKGROUND OF THE INVENTION

Few things are more frustrating than not being able to find an item that you just had in your hand. Such items typically may be maps, watches, keys, eyeglasses, remote controls, toys, and similar objects. However, there may be no object more frustrating to lose than a can of beer or other beverage that you were drinking. Such items can easily be carried around a home or drinking establishment and rather mindlessly set on any convenient surface whose location one does not remember. Moments later frustration can set in.

Users can spend undue amounts of time retracing their steps to find the item, which meanwhile may be becoming warmer. Should too much time be spent searching for the beverage, it may have to be discarded, thus costing money as well as time. Accordingly, there is a need for a means by which canned beverages can be easily found when misplaced. Beneficially such a means would also help keep a beverage cold while protecting a user's hands from that cold. Preferably, to enhance the enjoyments of that means it would also enable the playing of selected tunes.

SUMMARY OF THE INVENTION

The principles of the present invention provide for beverage koozies that not only help keep beverages cold while protecting users' hands, but also provides for key fob operated sound emitters for finding misplace beverages. To enhance the enjoyment of the beverage koozies the sound locators can play pre-programmed tunes under the control of the key fob. Additionally, sounds are emitted when beverages are inserted into the koozies.

A beverage koozie with locator is an insulated beverage holder, called a "koozie", and a wireless locator system. A beverage koozie with locator that is in accord with the present invention includes a koozie for insulating a beverage, a sound generating module for producing sound signals, and a key fob. The sound generating module including a switch that is activated by insertion of a beverage into the koozie. The sound generating module also includes a speaker for emitting sound in responses to the sound signals, and a battery for supplying power. The key fob includes a circuit board for emitting RF signals, at least a first sound button, and a fob battery for supplying power. The key fob emits a first RF signal when the first sound button is pressed, and in response the speaker emits a first sound for a sufficiently long period of time, such as at least fifteen seconds (15 sec.), to enable a user to find the beverage.

The beverage koozie with locator also emits a sound when the switch is activated by insertion of a beverage into the koozie. That insertion sound can be a beeping sound, an entertaining sound, or some other type of sound.

The beverage koozie with locator may further include a second button on the key fob. When the second button is pressed the speaker emits another sound. That sound may be pre-programmed. For convenience, the sound generating module can be mounted on or in the koozie, beneficially by using an adhesive.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
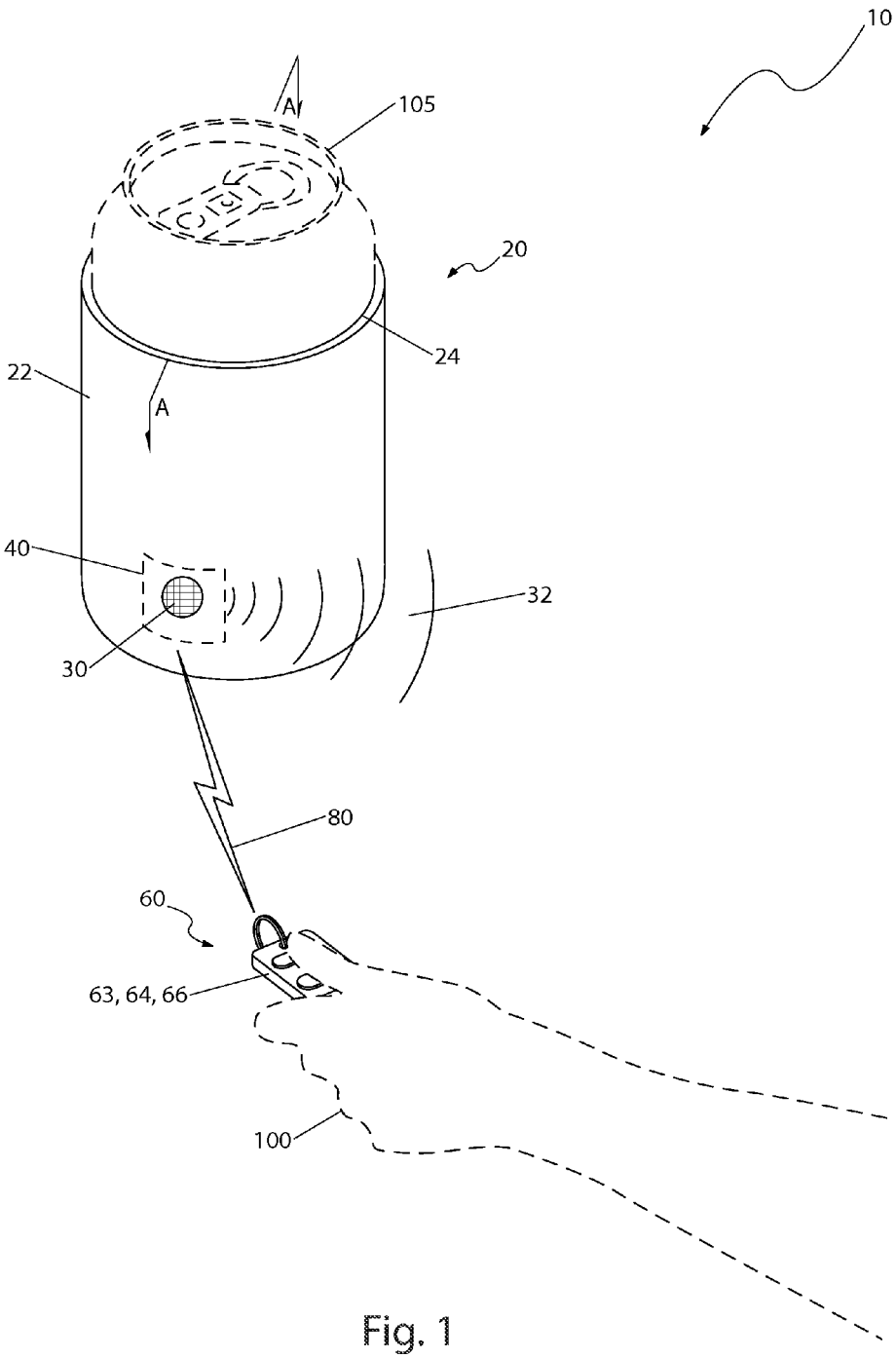
FIG. 1 is a perspective view of a beverage koozie with locator 10 that is in accord with the principles of the present invention.

10 beverage koozie with locator
20 koozie
22 side wall
24 top opening
26 bottom
30 speaker
32 audible sound
40 sound generating module
42 switch
44 receiver unit
46 first battery
48 first battery cover
60 fob
62 circuit board
63 first sound button
64 second sound button
66 third sound button
68 housing
70 keychain
72 second battery cover
74 second battery
80 RF (radio frequency) signal
100 user
105 beverage container

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Refer now to FIG. 1, which is a perspective view of a beverage koozie with locator 10. The beverage koozie with locator 10 includes an insulated beverage holder often called, and so called hereinafter, a koozie 20. The koozie 20 is shown insulating a beverage container 105 that extends from a top opening 24 of the koozie 20. The beverage koozie with locator 10 also includes a locator system having an integral sound generating module 40 that is in wireless communication with a key fob 60.

Figure 2:
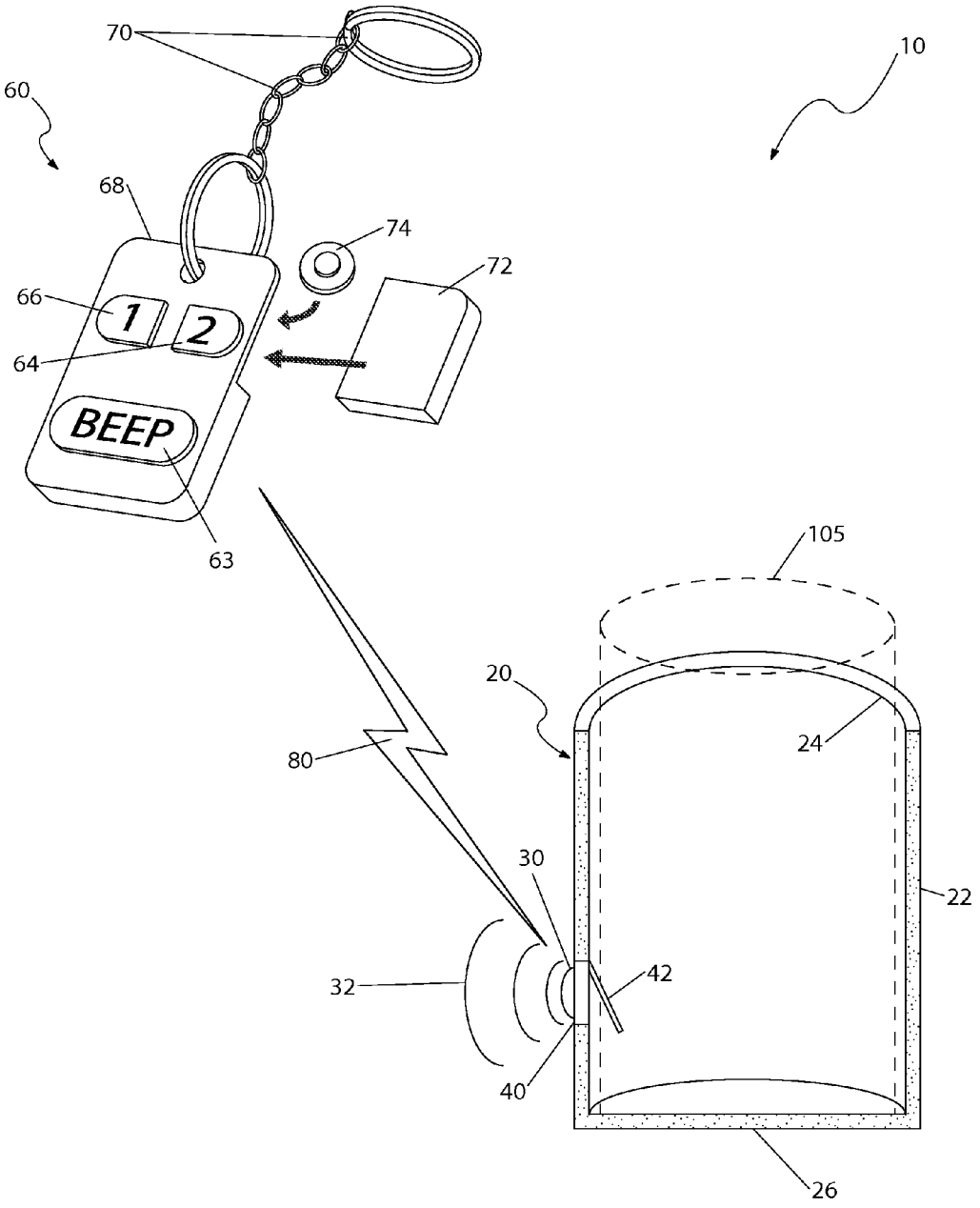
FIG. 2 is a section view of the beverage koozie with locator 10 taken along section line A-A of FIG. 1.

The koozie 20 comprises a container-shaped closed cell foam structure having a cylindrical side wall 22 and an integral bottom 26 (shown in FIG. 2). The koozie 20 supports the sound generating module 40, which includes an externally-mounted speaker 30. The sound generating module 40 emits sound when the key fob 60 is activated by a user 100 (and when a beverage is inserted into the koozie 20, see below). The key fob 60 is beneficially carried by the user 100 who will typically place their keys on a keychain 70 of the key fob 60 (see FIG. 2).

Referring primarily to FIG. 2, the key fob 60 is envisioned as being similar in size and design as key fobs commonly used for operating remote door locks and alarms of motor vehicles. The key fob 60 has a plastic housing 68 that provides protection and a mounting for an internal RF transmitter on a circuit board 62 (see FIG. 4) and a plurality of buttons, including a first sound button 63, a second sound button 64, and a third sound button 66. The plastic housing 68 also provides a feature, such as a hole to enable attachment of the keychain 70.

As shown in FIG. 2, the sound generating module 40 is located within the side wall of the koozie 22. The sound generating module 40 includes a switch 42 that extends slightly downward and into the interior of the koozie 20. The switch 42 is envisioned as a MICRO SWITCH™ or similar switch. This switch 42 initiates audible sounds 32, such as a beeping sound or an entertaining sound upon insertion of a beverage container 105 into the beverage koozie with locator 10.

A user 100 can locate the beverage koozie with locator 10 by pressing the first sound button 63 of the key fob 60. This causes the key fob 60 to transmit a specific RF signal 80 that induces the sound generating module 40 to emit a beeping audible sound 32 from the speaker 30 for a period of time, such as fifteen to twenty seconds (15-20 sec.). That period of time should be sufficient for a user 100 to locate the beverage koozie with locator 10.

In a similar manner the key fob 60 may initiate specific pre-programmed or pre-recorded audible sounds 32, such as entertaining ring tones, which are stored within a receiver unit 44 of the sound generating module 40 when the second sound button 64 or the third sound button 66 is pressed. In all events the audible sounds 32 are emitted from the speaker 30. Although the key fob 60 is illustrated as having three (3) buttons 63, 64, 66, it should be understood that the key fob 60 may provide more or fewer buttons.

Figure 3:
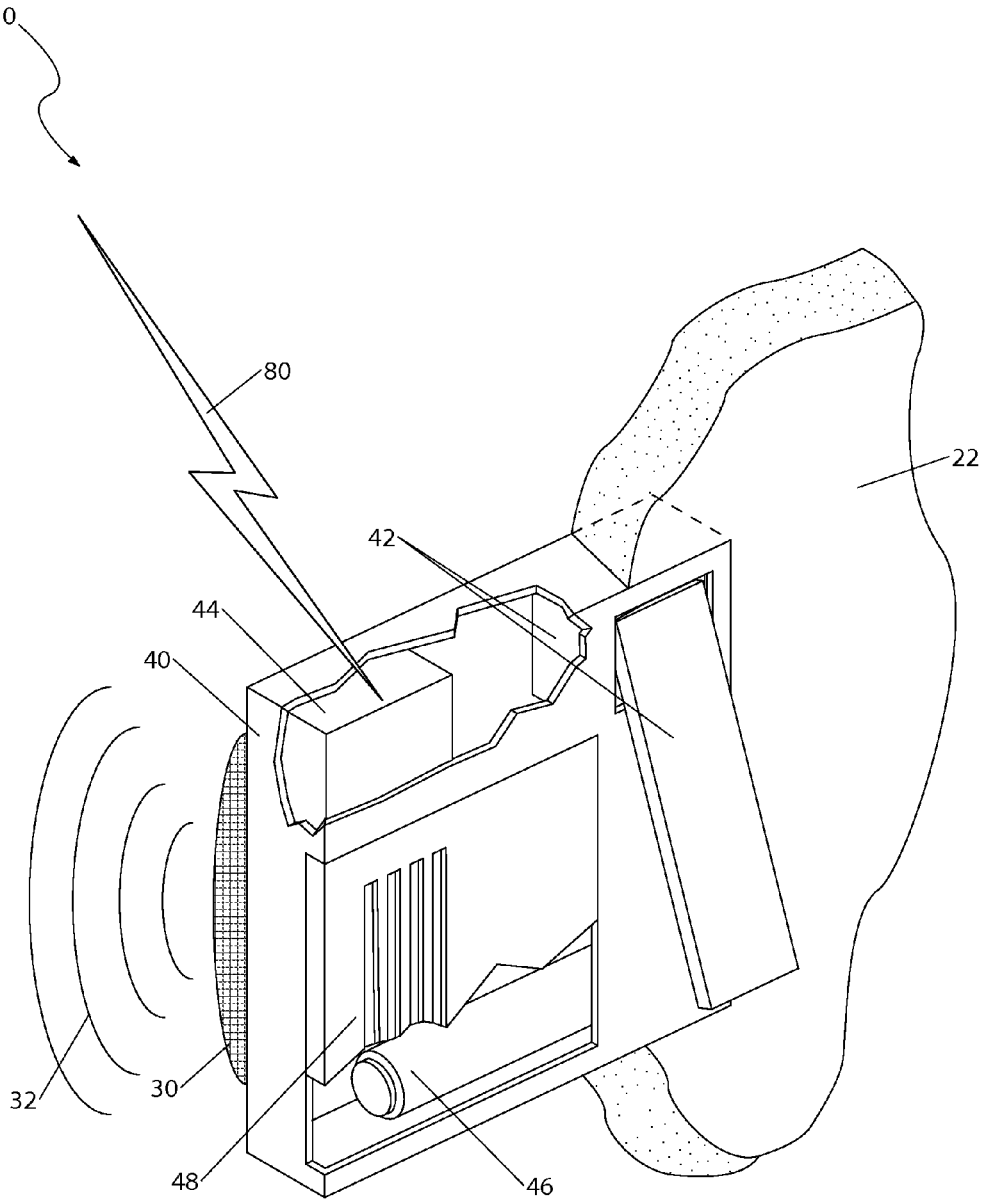
FIG. 3 is a partial section view of the beverage koozie with locator 10 shown in FIG. 1 and in FIG. 2; and, FIG. 4 is an electric block diagram of the beverage koozie with locator 10 shown in FIGS. 1-3.

The sound generating module 40 and the key fob 60 are respectively powered by a first battery 46 (see FIGS. 3 and 4) and a second battery 74 (also see FIGS. 2 and 3). The batteries 46, 74 are envisioned as standard size rechargeable or disposable DC cells. The batteries 46, 74 are respectively accessible for replacement via a first battery cover 48 and a second battery cover 72. The second battery 74 is installed in the key fob 60 by removing the second battery cover 72 from the key fob 60.

In use the beverage koozie with locator 10 reduces user frustration by enabling easy locating the beverage koozie with locator 10. Furthermore, the beverage koozie with locator 10 enables selectable broadcasting of entertaining audible sounds 32 by using the key fob 60.

FIG. 3 shows a partial breakaway view of the sound generating module 40 of the beverage koozie with locator 10. As shown, the sound generating module 40 comprises a miniature rectangular (beneficially plastic) enclosure which contains all electrical and electronic devices necessary for the operation of the sound generating module 40. The sound generating module 40 is beneficially flush mounted into a lower part of the side wall 22 using adhesives.

The sound generating module 40 includes the speaker 30, the switch 42, a receiver unit 44, the first battery 46, and a first battery cover 48. The sound generating module 40 is powered by the first battery 46, which is accessible via the battery cover 48. The switch 42 connects electrical power from the first battery 46 to the sound generating module 40 when a beverage container 105 is inserted into the koozie 20. This enables the locating and sound generating functions. The speaker 30 is a miniature piezo-type-speaker mounted to an outer surface of the sound generating module 40. Once energized, RF signal 80 from the fob 60 by the receiver unit 44 initiates audible sound 32 from the speaker 30.

Figure 4:
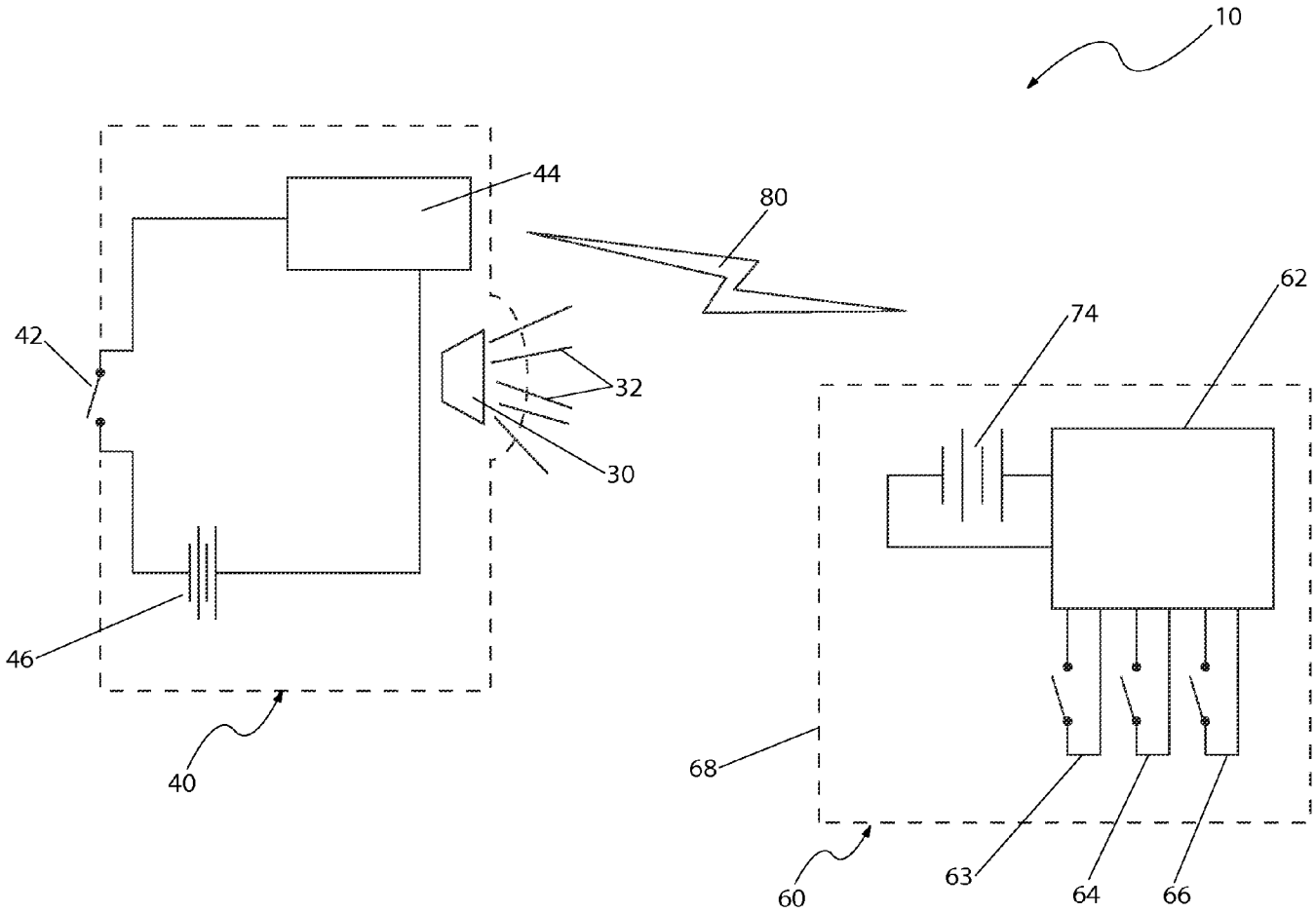

FIG. 4 presents an electric block diagram of the beverage koozie with locator 10. The key fob 60 buttons 63, 64, 66 initiate transmission of respective variable RF signals 80 from an internal circuit board 62. The circuit board 62 supports RF modulating components, an antenna, embedded software, and the like as required. The transmitted RF signal 80 is received by the receiver unit 44 which, as noted, is in electrical communication with the speaker 30. The speaker 30 emits different sounds depending on which button 63, 64, 66 is pressed by the user 100.

It is envisioned that other styles and configurations of the present invention can be easily incorporated into the teachings of the present invention. Showing and describing only one particular configuration is for purposes of clarity and disclosure and not limitation of scope.

The beverage koozie with locator 10 can be utilized by the common user in a simple and effortless manner with little or no training. After initial purchase or acquisition of the beverage koozie with locator 10 it would be used as indicated in FIG. 1. To operate, batteries 46, 74 are installed into the sound generating module 40 and key fob 60. A beverage container 105 is inserted into the koozie 20 in a normal manner, thus engaging the switch 42 and energizing the sound generating module 40. Then using the koozie 20 in a conventional manner to consume the beverage in the container 105, a person can locate a misplaced koozie 20 and beverage container 105 by pressing the first sound button 63, thereby causing a beeping audible sound 32 to be emitted from the speaker 30. A user then locates the koozie 20 upon hearing the audible sound 32 and retrieves the beverage koozie with locator 10 and beverage container 105, benefiting from reduced frustration.

The method of utilizing the beverage koozie with locator 10 to emit alternate entertaining audible sounds 32 may be achieved by pressing either the second sound button 64 or the third sound button 66 to initiate emitting corresponding pre-programmed or prerecorded audible sounds 32 from the speaker 30.

The foregoing descriptions of specific embodiments have been presented for purposes of illustration and description.

They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A beverage koozie with locator, comprising:

a koozie for insulating a beverage, said koozie including a body with a bottom and a vertical side that define an interior;

a sound generating module for producing sound signals which is mounted to and extends through said vertical side, said sound generating module including a receiver for receiving RF signals and a switch that extends into said interior and which is activated by insertion of a beverage into said koozie, an externally mounted speaker on the vertical side for emitting sound, and a replaceable locator battery accessible by a first cover for supplying power, wherein said power is supplied to said receiver when said switch is activated; and, a key fob having a circuit board for emitting RF signals, at least a first sound button, and a fob battery for supplying power, wherein said key fob emits a first RF signal when said first sound button is pressed;

wherein said externally mounted speaker emits a first sound when said first RF signal is received.

2. The beverage koozie with locator according to claim 1, wherein said switch initiates said sound generating module to emit an insertion sound when said switch is first activated.

3. The beverage koozie with locator according to claim 2, wherein said insertion sound is a beeping sound.

4. The beverage koozie with locator according to claim 2, wherein said insertion sound is implemented to be an entertaining sound.

5. The beverage koozie with locator according to claim 1, wherein said the first sound is emitted for fifteen seconds.

6. The beverage koozie with locator according to claim 5, wherein said key fob further includes a second sound button, wherein said key fob emits a second RF signal when said second sound button is pressed, and wherein said externally mounted speaker emits a second sound when said second sound button is pressed.

7. The beverage koozie with locator according to claim 6, wherein said second sound is pre-programmed.

8. The beverage koozie with locator according to claim 1, wherein said sound generating module is mounted on said koozie using an adhesive.

* * * * *